US011242980B2

(12) United States Patent
Huang et al.

(10) Patent No.: US 11,242,980 B2
(45) Date of Patent: Feb. 8, 2022

(54) LIGHTING APPARATUS

(71) Applicant: XIAMEN LEEDARSON LIGHTING CO., LTD, Fujian (CN)

(72) Inventors: Zhenkun Huang, Fujian (CN); Shouqiang Hou, Fujian (CN); Xiaoliang Wen, Fujian (CN)

(73) Assignee: XIAMEN LEEDARSON LIGHTING CO., LTD, Fujian (CN)

( * ) Notice: Subject to any disclaimer, the term of this patent is extended or adjusted under 35 U.S.C. 154(b) by 0 days.

(21) Appl. No.: 17/029,878

(22) Filed: Sep. 23, 2020

(65) Prior Publication Data

US 2021/0088202 A1 Mar. 25, 2021

(30) Foreign Application Priority Data

Sep. 23, 2019 (CN) ..... 201921587855.3
Sep. 23, 2019 (CN) ..... 201921588774.5
Sep. 23, 2019 (CN) ..... 201921588992.9

(51) Int. Cl.
*F21V 19/00* (2006.01)
*F21S 4/28* (2016.01)
(Continued)

(52) U.S. Cl.
CPC ..... *F21V 19/009* (2013.01); *F21S 4/28* (2016.01); *F21V 19/001* (2013.01); *F21V 23/06* (2013.01); *F21Y 2115/10* (2016.08)

(58) Field of Classification Search
CPC ..... F21V 19/009; F21V 19/001; F21V 23/06; F21V 23/0442; F21V 19/008; F21V 21/08; F21V 21/14; F21V 33/00; F21V 33/0012; F21S 4/28; F21S 8/031; F21Y 2115/10; F21Y 2103/00; F21Y 2103/10; F21W 2131/301
See application file for complete search history.

(56) References Cited

U.S. PATENT DOCUMENTS 3,535,638 A * 10/1970 Michelin ..... H01R 25/003 324/149
7,726,869 B2 * 6/2010 Chien ..... F21K 9/66 362/648

(Continued)

FOREIGN PATENT DOCUMENTS

DE 102012216341 * 3/2014 ..... F21V 33/00

OTHER PUBLICATIONS

Andreas Fishcer, DE 102012216341, Mar. 13, 2014, English translation of Description (Year: 2014).*

*Primary Examiner* — Peggy A Neils
(74) *Attorney, Agent, or Firm* — Chun-Ming Shih; Lanway IPR Services

(57) ABSTRACT

A lighting apparatus includes a base housing, an elongated light source module and at least one holder hook. The base housing has a main body and two arms. The two arms are extended from the main body. Each of the two arms has a base connector. The elongated light source module has two light connectors respectively detachably connected to the base connectors of the arms. The elongated light source module emits a light having a main direction. The elongated light source module is rotatable with respect to the base connectors for adjusting the main direction. At least one holder hook is extended from the main body for detachably hooking an object.

19 Claims, 12 Drawing Sheets

(51) Int. Cl.
*F21V 23/06* (2006.01)
*F21Y 115/10* (2016.01)

(56) References Cited

U.S. PATENT DOCUMENTS

| | | | | |
|---|---|---|---|---|
| 8,033,688 | B2 * | 10/2011 | Warton | F21V 19/008 362/269 |
| 10,323,835 | B1 * | 6/2019 | Anderson | F21V 33/00 |
| 2009/0147504 | A1 * | 6/2009 | Teeters | H01R 31/02 362/153 |
| 2009/0159919 | A1 * | 6/2009 | Simon | F21K 9/272 257/99 |
| 2014/0376213 | A1 * | 12/2014 | Miedema | F21V 33/0044 362/127 |
| 2017/0175995 | A1 * | 6/2017 | Zhong | G02B 6/0068 |
| 2019/0098725 | A1 * | 3/2019 | Sadwick | H05B 45/20 |

* cited by examiner

LIGHTING APPARATUS

FIELD

The present invention is related to a lighting apparatus, and more particularly related to a lighting apparatus with an adjustable light output.

BACKGROUND

The time when the darkness is being lighten up by the light, human have noticed the need of lighting up this planet. Light has become one of the necessities we live with through the day and the night. During the darkness after sunset, there is no natural light, and human have been finding ways to light up the darkness with artificial light. From a torch, candles to the light we have nowadays, the use of light have been changed through decades and the development of lighting continues on.

Early human found the control of fire which is a turning point of the human history. Fire provides light to bright up the darkness that have allowed human activities to continue into the darker and colder hour of the hour after sunset. Fire gives human beings the first form of light and heat to cook food, make tools, have heat to live through cold winter and lighting to see in the dark.

Lighting is now not to be limited just for providing the light we need, but it is also for setting up the mood and atmosphere being created for an area. Proper lighting for an area needs a good combination of daylight conditions and artificial lights. There are many ways to improve lighting in a better cost and energy saving. LED lighting, a solid-state lamp that uses light-emitting diodes as the source of light, is a solution when it comes to energy-efficient lighting. LED lighting provides lower cost, energy saving and longer life span.

The major use of the light emitting diodes is for illumination. The light emitting diodes is recently used in light bulb, light strip or light tube for a longer lifetime and a lower energy consumption of the light. The light emitting diodes shows a new type of illumination which brings more convenience to our lives. Nowadays, light emitting diode light may be often seen in the market with various forms and affordable prices.

After the invention of LEDs, the neon indicator and incandescent lamps are gradually replaced. However, the cost of initial commercial LEDs was extremely high, making them rare to be applied for practical use. Also, LEDs only illuminated red light at early stage. The brightness of the light only could be used as indicator for it was too dark to illuminate an area. Unlike modern LEDs which are bound in transparent plastic cases, LEDs in early stage were packed in metal cases.

In 1878, Thomas Edison tried to make a usable light bulb after experimenting different materials. In November 1879, Edison filed a patent for an electric lamp with a carbon filament and keep testing to find the perfect filament for his light bulb. The highest melting point of any chemical element, tungsten, was known by Edison to be an excellent material for light bulb filaments, but the machinery needed to produce super-fine tungsten wire was not available in the late 19th century. Tungsten is still the primary material used in incandescent bulb filaments today.

Early candles were made in China in about 200 BC from whale fat and rice paper wick. They were made from other materials through time, like tallow, spermaceti, colza oil and beeswax until the discovery of paraffin wax which made production of candles cheap and affordable to everyone. Wick was also improved over time that made from paper, cotton, hemp and flax with different times and ways of burning. Although not a major light source now, candles are still here as decorative items and a light source in emergency situations. They are used for celebrations such as birthdays, religious rituals, for making atmosphere and as a decor.

Illumination has been improved throughout the times. Even now, the lighting device we used today are still being improved. From the illumination of the sun to the time when human can control fire for providing illumination which changed human history, we have been improving the lighting source for a better efficiency and sense. From the invention of candle, gas lamp, electric carbon arc lamp, kerosene lamp, light bulb, fluorescent lamp to LED lamp, the improvement of illumination shows the necessity of light in human lives.

There are various types of lighting apparatuses. When cost and light efficiency of LED have shown great effect compared with traditional lighting devices, people look for even better light output. It is important to recognize factors that can bring more satisfaction and light quality and flexibility.

People fix various light devices to different surfaces, e.g. a closet, a table, a cabin.

When such light device is fixed to the different installation surfaces, it is important to consider factors of safety, convenience and flexibility.

It is beneficial to design an innovative way of a flexible lighting device.

SUMMARY

In some embodiments, a lighting apparatus includes a base housing, an elongated light source module, and at least one holder hook.

The base housing has a main body and two arms.

The two arms are extended from the main body. Each of the two arms has a base connector.

The elongated light source module has two light connectors respectively detachably connected to the base connectors of the arms.

The elongated light source module emits a light having a main direction. The elongated light source module is rotatable with respect to the base connectors for adjusting the main direction.

At least one holder hook is extended from the main body for detachably hooking an object.

The elongated light source module may have a rectangular housing or a tubular housing with an elongated shape with two opposite ends having the light connectors.

The elongated light source module is rotated by a user to adjust the main direction of the light emitted by the elongated light source module.

The holder hook may be a simple hook or a hook that may be used for holding stuffs placed on the hook.

In some embodiments, the holder hook may have an inverted hook structure, a magnetic unit, a pluggable structure or other structures for detachably fixing some object to the holder hook.

When the holder hook is fixed to the main body and the main body is fixed to the installation surface, the object is therefore hooked to a required position.

The term "hook" mentioned here refers to attaching an object to another object, not limiting its shapes or structures.

In some embodiments, the holder hook has an electricity socket for supplying power to the objected hooked on the holder hook.

For example, the electricity socket may be a common USB socket. Users may use the socket to charge mobile phones or other devices.

Such electricity socket may also be placed with a battery module to supply power to the elongated light source module. For example, when indoor electricity stops accidentally, a battery module may be used to connect to the lighting apparatus to provide an emergency illumination.

In addition, speakers, wireless device or other function module may be attached to the electricity socket to acquire power supply and even co-work with circuits in the lighting apparatus. For example, the driver circuit of the lighting apparatus may not have wireless communication capability at first. By adding a wireless device, the driver circuit is integrated to work with the wireless device plugged on the holder hook to receive and/or transmit signals from and to an external device.

In some embodiments, an auxiliary light device is plugged to the holder hook providing a second light source.

In some embodiments, an auxiliary light device is attached for providing a second light source providing lights with different parameters, e.g. a different color temperature or an intensity unlike the light of the elongated light source module.

In some embodiments, the lighting apparatus has a manual switch for adjusting a set of light parameters like color temperatures.

Multiple LED modules with different color temperatures may be disposed in the elongated light source module and controlled by a driver circuit to mix a light with a required color temperature.

Such setting may also be sent from an external device using wireless communication. When the driver circuit for the lighting apparatus receives such setting, the driver circuit adjusts the light output according to the received setting.

In some embodiments, the elongated light source module has a luminance flat surface.

In some embodiments, the luminance flat surface emits a light more even instead of a bar or a tubular light source.

Light guide plates, which are made of transparent plastic materials and disposed with lots of micro light escape dots, with or without a diffusion layer, may be used for the luminance flat surface.

In some embodiments, the elongated light source module has multiple LED modules divided into multiple areas.

Each area has a different density of the LED modules for generating a required projection intensity pattern corresponding to the densities of the areas of the LED modules.

In some embodiments, the light is designed to generate a projected light pattern on a table surface or a closet surface.

There are several examples with different design requirements.

For example, in an example, the projected light pattern is required to be as even as possible for light intensity on different projected areas. In such example, the LED densities in different areas are adjusted so that the final projected light pattern has similar light intensity in different projected areas. This is because the LED modules in different areas of the elongated light source module may have different projecting paths and thus their relative positions among neighboring LED modules need to be adjusted to produce an even projected output.

In some other example, certain projected areas need to be focused. In such case, the LED modules are arranged for adjusting distances to neighboring LED modules, i.e. changing LED densities in different areas, to achieve the required projected light pattern.

In some embodiments, the luminance flat surface is bendable to a curve surface to change a output light pattern.

In some embodiment, the luminance flat surface may even be bent by a user to further change the projected light pattern.

In some embodiments, the elongated light source module is detachable from the base connector to be replaced with another light device having the same light connectors.

For example, another elongated light source module with different housing shapes or even a different device, if they have the same light connectors may be attached to the base connectors for getting electricity supply and also structural connection.

In some embodiments, said another light device is a standard light tube.

In some embodiments, a standard light tube, like a A8 light tube, which may include LED modules or may be a traditional fluorescent light tube, may be used to replace the elongated light source module.

In some embodiments, the elongated light source module has a socket for inserting a standard light tube.

In some embodiment, the elongated light source module may be a holder for attaching one or more than standard light tubes.

In some embodiments, a top surface of the main body is attached to an installation surface.

For example, the installation surface may be a closet surface, a table surface, a cabin surface.

In some embodiments, a bracket is fixed to the installation surface and the top surface has a fixing connector fixing to the bracket.

The bracket is fixed to the installation surface first. Then, the main body is plugged, or hooked to the bracket. Such design simplifies the assembly work.

In some embodiments, a lateral wall of the main body is fixed to a installation wall.

In addition to the top surface, the lateral surface of the main body may also be used for fixing the lighting apparatus. Such design increase options for attaching the lighting apparatus to different installation surfaces.

In some embodiments, the base connector is elastically movable when attaching the corresponding light connector.

In some embodiments, the base connector may be moved elastically to allocate space for installing the light connector and recovers with elastic force to keep the light connector at installation positions.

In some embodiments, the light connector has a inner circular gear structure corresponding to the base connector for being rotated segment by segment.

Such gear structures makes rotation segment by segment and the positioning of the output light more stable, not easy to get changed accidentally.

In some embodiments, different rotation angles of the elongated light source module with respect to the main body correspond to different light parameters output by the elongated light source module.

The changing parameters may include light intensity, light color temperature, color or other parameters.

In some embodiments, the elongated light source may provide a general soft illumination for a room in a first rotation angle. The elongated light source may provide a focus light beam on a desk surface in a second rotation angle.

In some embodiments, the elongated light source module is turned on and turned off by rotating the elongated light source module to two rotation positions.

In some embodiments, the lighting apparatus may be turned on or turned off by rotating the elongated light source module.

In some embodiments, the main body has a wiring hole disposed with a wire stop.

The wire stop has a top pressing unit for being pressed to move the wire stop to fix an inserted wire to the wire stop.

Power wires may be inserted to an opening of the main body. The wire stop is disposed adjacent to the opening and used for fixing the inserted wire.

In some embodiments, the wire stop has a cut unit for cutting an insulation layer of the inserted wire.

The cut unit may have a metal surface for cutting a portion of the insulation layer of a power wire and meanwhile presses the power wire at a desired position to keep electricity connection to the components of the lighting apparatus.

In some embodiments, the main body is connected to an input wire and an output wire.

The input wire is used for transmitting an input power and the output wire is used for routing the power supply to a connected device.

More than one same type lighting apparatuses may be connected in series with such design.

In some embodiments, devices not the same as the lighting apparatus may also be connected in series.

In some embodiments, the main body has a power circuit for connecting the input wire and the output wire.

The power circuit also has a detector for breaking the power supply to the connected device when abnormal condition is detected at the output wire.

To keep safety, when a connected device is found having abnormal situation, e.g. strange current value, high temperature, the detector detects such condition and cuts power supply to the connected device.

DETAILED DESCRIPTION

Figure 15:
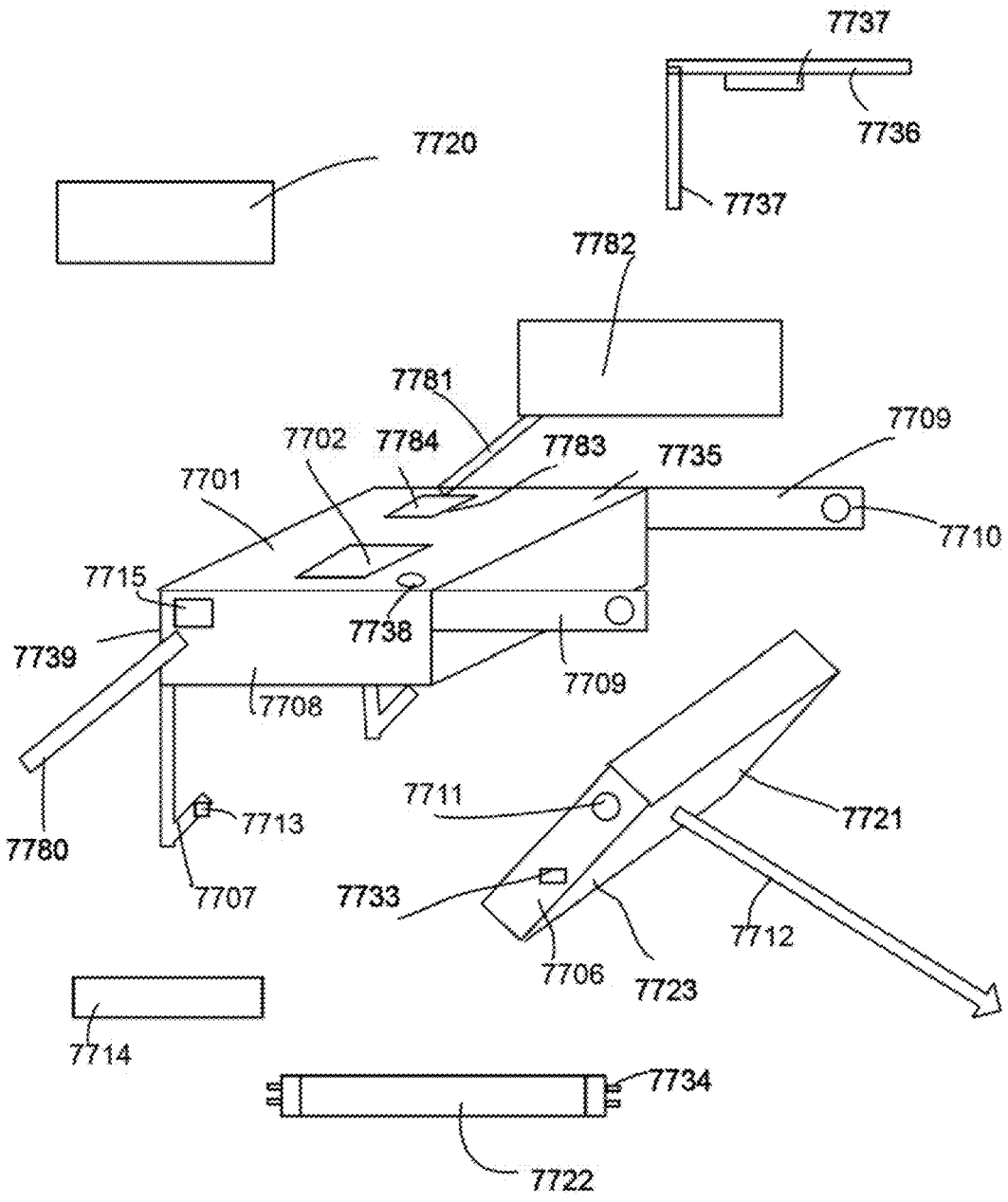
FIG. 15 shows component relation in an embodiment.

In FIG. 15, a lighting apparatus includes a base housing 7701, an elongated light source module 7706, and at least one holder hook 7707.

The base housing 7701 has a main body 7708 and two arms 7709.

The two arms 7709 are extended from the main body 7708. Each of the two arms 7709 has a base connector 7710.

The elongated light source module 7706 has two light connectors 7711 respectively detachably connected to the base connectors 7710 of the arms 7709.

The elongated light source module 7711 emits a light having a main direction 7712. The elongated light source module 7706 is rotatable with respect to the base connectors 7711 for adjusting the main direction 7712.

At least one holder hook 7707 is extended from the main body 7701 for detachably hooking an object 7714.

The elongated light source module 7706 may have a rectangular housing or a tubular housing with an elongated shape with two opposite ends having the light connectors 7711.

The elongated light source module 7706 is rotated by a user to adjust the main direction 7712 of the light emitted by the elongated light source module 7706.

The holder hook 7707 may be a simple hook or a hook that may be used for holding stuffs placed on the hook.

In some embodiments, the holder hook 7707 may have an inverted hook structure, a magnetic unit, a pluggable structure or other structures for detachably fixing some object to the holder hook.

When the holder hook is fixed to the main body and the main body is fixed to the installation surface, the object is therefore hooked to a required position.

The term "hook" mentioned here refers to attaching an object to another object, not limiting its shapes or structures.

In some embodiments, the holder hook 7707 has an electricity socket 7713 for supplying power to the object 7714 hooked on the holder hook 7707.

For example, the electricity socket 7713 may be a common USB socket. Users may use the socket to charge mobile phones or other devices.

Such electricity socket 7713 may also be placed with a battery module to supply power to the elongated light source module. For example, when indoor electricity stops accidentally, a battery module may be used to connect to the lighting apparatus to provide an emergency illumination.

In addition, speakers, wireless device or other function module may be attached to the electricity socket 7713 to acquire power supply and even co-work with circuits in the lighting apparatus. For example, the driver circuit of the lighting apparatus may not have wireless communication capability at first. By adding a wireless device, the driver circuit 7702 is integrated to work with the wireless device plugged on the holder hook 7707 to receive and/or transmit signals from and to an external device.

In some embodiments, an auxiliary light device is plugged to the holder hook providing a second light source.

In some embodiments, an auxiliary light device is attached for providing a second light source providing lights with different parameters, e.g. a different color temperature or an intensity unlike the light of the elongated light source module.

In some embodiments, the lighting apparatus has a manual switch 7715 for adjusting a set of light parameters like color temperatures.

Figure 16:
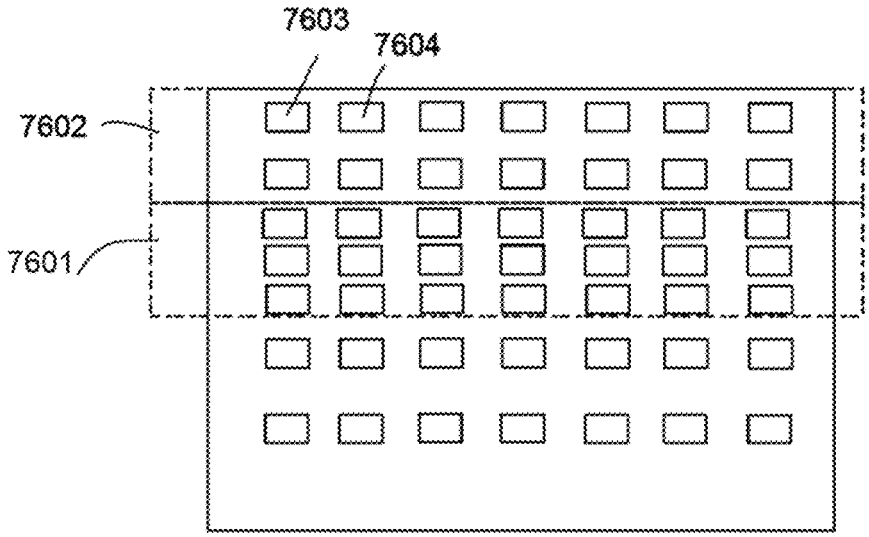
FIG. 16 shows LED module densities in different areas.

In FIG. 16, multiple LED modules 7603, 7604 with different color temperatures may be disposed in the elongated light source module and controlled by a driver circuit 7702 to mix a light with a required color temperature.

In FIG. 15, such setting may also be sent from an external device 7720 using wireless communication. When the driver circuit 7702 of the lighting apparatus receives such setting, the driver circuit adjusts the light output according to the received setting.

In FIG. 15, the elongated light source module has a luminance flat surface 7721.

In some embodiments, the luminance flat surface 7721 emits a light more even instead of a bar or a tubular light source 7722.

Light guide plates 7723, which are made of transparent plastic materials and disposed with lots of micro light escape dots, with or without a diffusion layer, may be used for the luminance flat surface.

In FIG. 16, the elongated light source module has multiple LED modules divided into multiple areas 7601, 7602.

Each area has a different density of the LED modules for generating a required projection intensity pattern corresponding to the densities of the areas of the LED modules.

In some embodiments, the light is designed to generate a projected light pattern on a table surface or a closet surface.

There are several examples with different design requirements.

For example, in an example, the projected light pattern is required to be as even as possible for light intensity on different projected areas. In such example, the LED densities in different areas are adjusted so that the final projected light pattern has similar light intensity in different projected areas. This is because the LED modules in different areas of the elongated light source module may have different projecting paths and thus their relative positions among neighboring LED modules need to be adjusted to produce an even projected output.

In some other example, certain projected areas need to be focused. In such case, the LED modules are arranged for adjusting distances to neighboring LED modules, i.e. changing LED densities in different areas, to achieve the required projected light pattern.

In some embodiments, the luminance flat surface is bendable to a curve surface to change a output light pattern.

Figure 17:
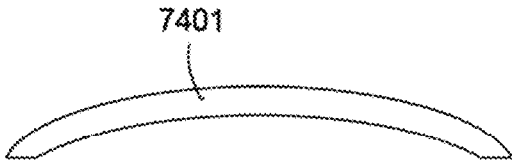
FIG. 17 shows a bent luminance flat surface.

In FIG. 17, the luminance flat surface 7401 may even be bent by a user to further change the projected light pattern.

In some embodiments, the elongated light source module is detachable from the base connector to be replaced with another light device having the same light connectors.

For example, another elongated light source module with different housing shapes or even a different device, if they have the same light connectors may be attached to the base connectors for getting electricity supply and also structural connection.

In some embodiments, said another light device is a standard light tube.

In FIG. 15, a standard light tube 7722, like a A8 light tube, which may include LED modules or may be a traditional fluorescent light tube, may be used to replace the elongated light source module.

In FIG. 15, the elongated light source module has a socket 7733 for inserting a standard light tube 7722 with standard pins 7734.

In some embodiment, the elongated light source module may be a holder for attaching one or more than standard light tubes.

In some embodiments, a top surface 7735 of the main body 7701 is attached to an installation surface 7736.

For example, the installation surface 7736 may be a closet surface, a table surface, a cabin surface.

In some embodiments, a bracket 7737 is fixed to the installation surface 7736 and the top surface 7735 has a fixing connector 7738 fixing to the bracket 7737.

The bracket is fixed to the installation surface first. Then, the main body is plugged, or hooked to the bracket. Such design simplifies the assembly work.

In some embodiments, a lateral wall 7739 of the main body 7701 is fixed to an installation wall 7737.

In addition to the top surface, the lateral surface of the main body may also be used for fixing the lighting apparatus. Such design increase options for attaching the lighting apparatus to different installation surfaces.

In some embodiments, the base connector 7710 is elastically movable when attaching the corresponding light connector.

In some embodiments, the base connector may be moved elastically to allocate space for installing the light connector and recovers with elastic force to keep the light connector at installation positions.

Figure 12:
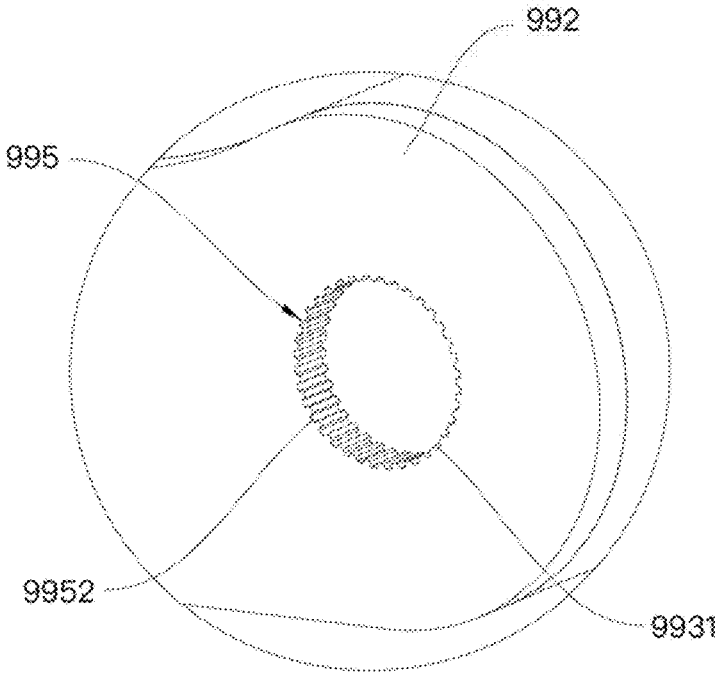
FIG. 12 illustrates a light connector in an embodiment.

In FIG. 12, the light connector has an inner circular gear structure 995 corresponding to the base connector 7710 for being rotated segment by segment.

Such gear structures make rotation segment by segment and the positioning of the output light more stable, not easy to get changed accidentally.

In some embodiments, different rotation angles of the elongated light source module with respect to the main body correspond to different light parameters output by the elongated light source module.

The changing parameters may include light intensity, light color temperature, color or other parameters.

In some embodiments, the elongated light source may provide a general soft illumination for a room in a first rotation angle. The elongated light source may provide a focus light beam on a desk surface in a second rotation angle.

In some embodiments, the elongated light source module is turned on and turned off by rotating the elongated light source module to two rotation positions.

In some embodiments, the lighting apparatus may be turned on or turned off by rotating the elongated light source module.

Figure 18:
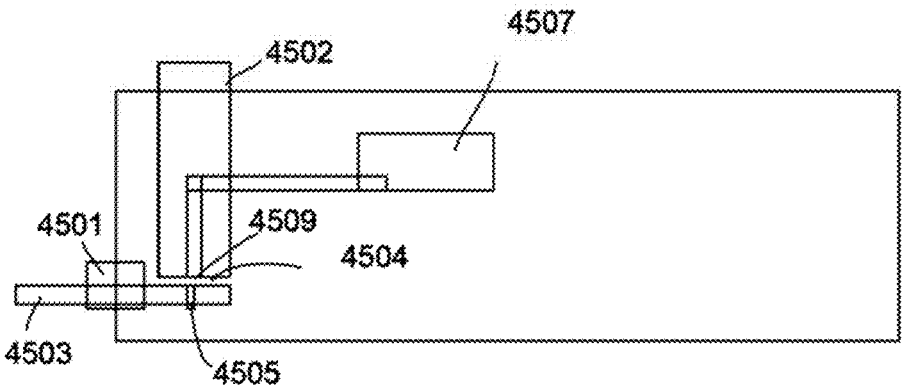
FIG. 18 shows a wiring hole and a wire stop.

In FIG. 18, the main body has a wiring hole 4501 disposed with a wire stop 4502.

The wire stop 4502 has a top pressing unit 4504 for being pressed to move the wire stop 4502 to fix an inserted wire 4503 to the wire stop 4502.

Power wires 4503 may be inserted to an opening 4501 of the main body. The wire stop 4502 is disposed adjacent to the opening 4501 and used for fixing the inserted wire 4503.

In some embodiments, the wire stop 4502 has a cut unit 4509 for cutting an insulation layer 4505 of the inserted wire 4503 to expose the metal wire and to connect the metal wire to a conductive path.

The cut unit may have a metal surface for cutting a portion of the insulation layer of a power wire and meanwhile presses the power wire at a desired position to keep electricity connection to the components of the lighting apparatus.

In FIG. 15, the main body is connected to an input wire 7780 and an output wire 7781.

The input wire 7780 is used for transmitting an input power and the output wire 7781 is used for routing the power supply to a connected device 7782.

More than one same type lighting apparatuses may be connected in series with such design.

In some embodiments, devices not the same as the lighting apparatus may also be connected in series.

In some embodiments, the main body has a power circuit for 7783 connecting the input wire and the output wire.

The power circuit 7783 also has a detector 7784 for breaking the power supply to the connected device 7782 when abnormal condition is detected at the output wire 7781.

To keep safety, when a connected device is found having abnormal situation, e.g. strange current value, high temperature, the detector detects such condition and cuts power supply to the connected device.

Figure 1:
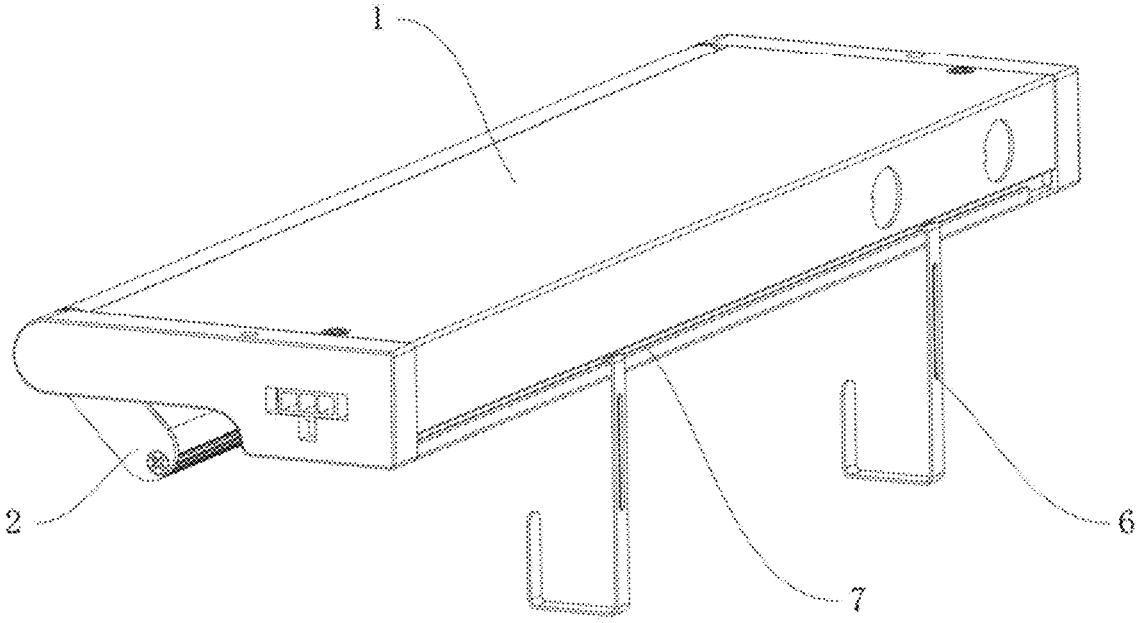
FIG. 1 illustrates a lighting apparatus embodiment.

Please refer to FIG. 1. In FIG. 1, a lighting apparatus includes a base housing 1, an elongated light source module 2 and two holder hooks 6. The two holder hooks 6 are detachably attach to the base housing 1 to a groove of a base housing 1.

Figure 2:
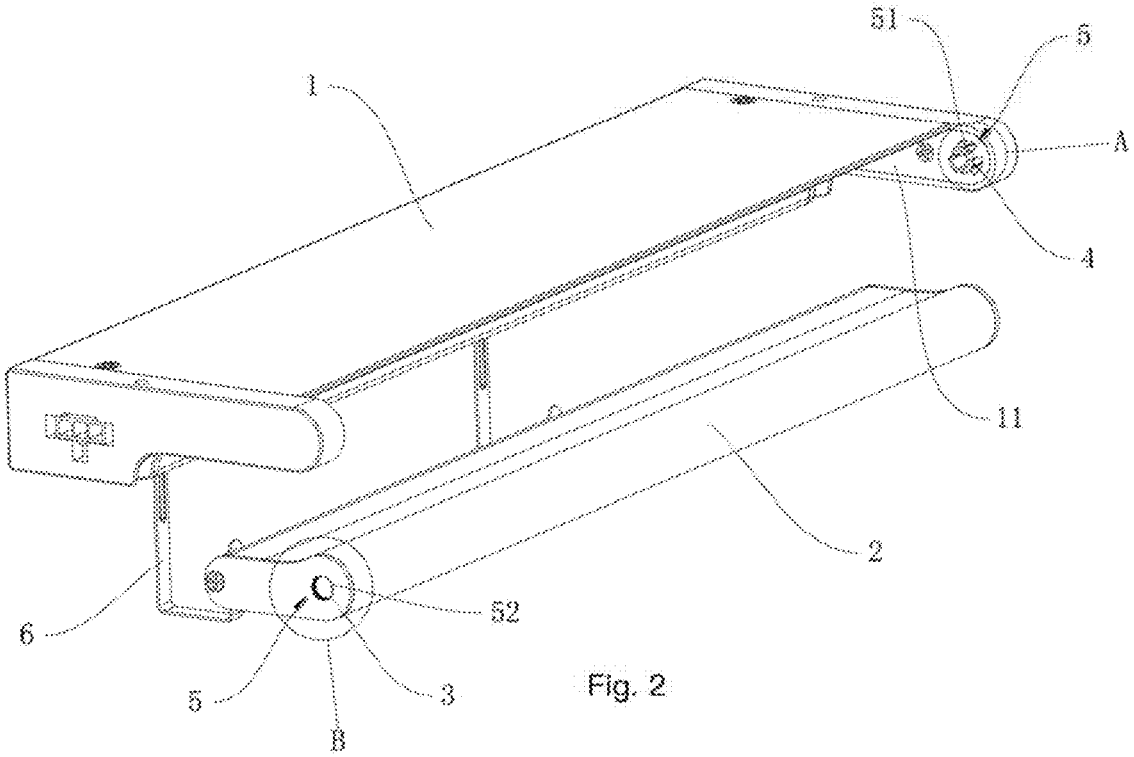
FIG. 2 illustrates the example of FIG. 1, in which the elongated light source module is detached.

FIG. 2 shows another view of the example of FIG. 1.

In FIG. 2, the base housing 1 has a base connector 5 with a positioning rim 51 and a rotation shaft 4. The base housing has two arms 11 for installing the elongated light source module 2. The elongated light source module 2 has a light connector 3 with an inner circular gear structure 52 for connecting to a base connector 5. The same reference numerals refer to the same components and are not repeated again for brevity.

Figure 3:
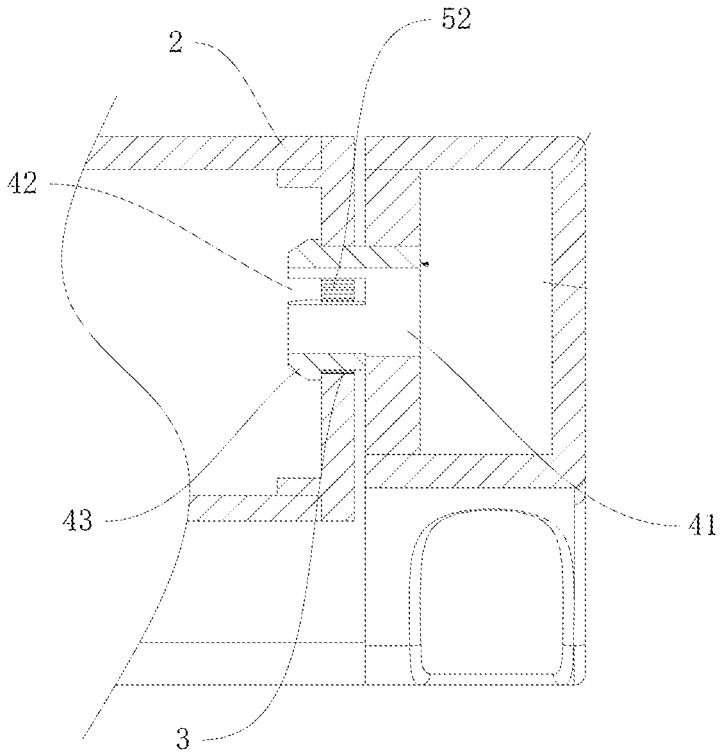
FIG. 3 illustrates a cross-sectional view of rotatable components.

In FIG. 3, a further detailed zoom-up view shows an escape groove 42, escape-prevention block 43, and an escape hole 41 are used for installing the elongated light source module 2.

Figure 4:
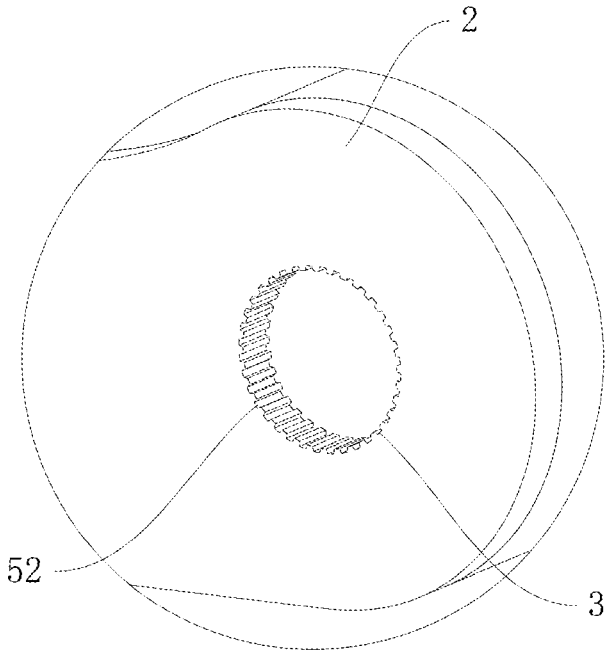
FIG. 4 illustrates a zoom-up view of a light connector example.

In FIG. 4, the inner circular gear structure 52 is illustrated for providing segment to segment movement.

Figure 5:
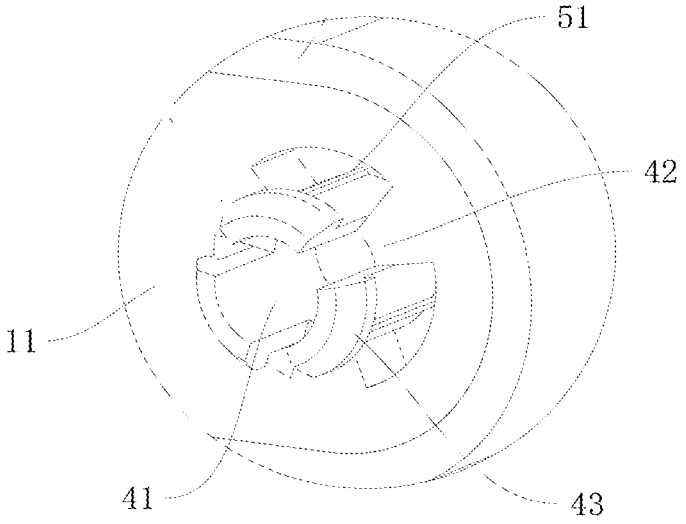
FIG. 5 illustrates a zoom-up view of a base connector example.

FIG. 5 shows components mentioned in FIG. 3 in a perspective view on how a base connector may be designed for attaching the elongated light source module.

Figure 6:
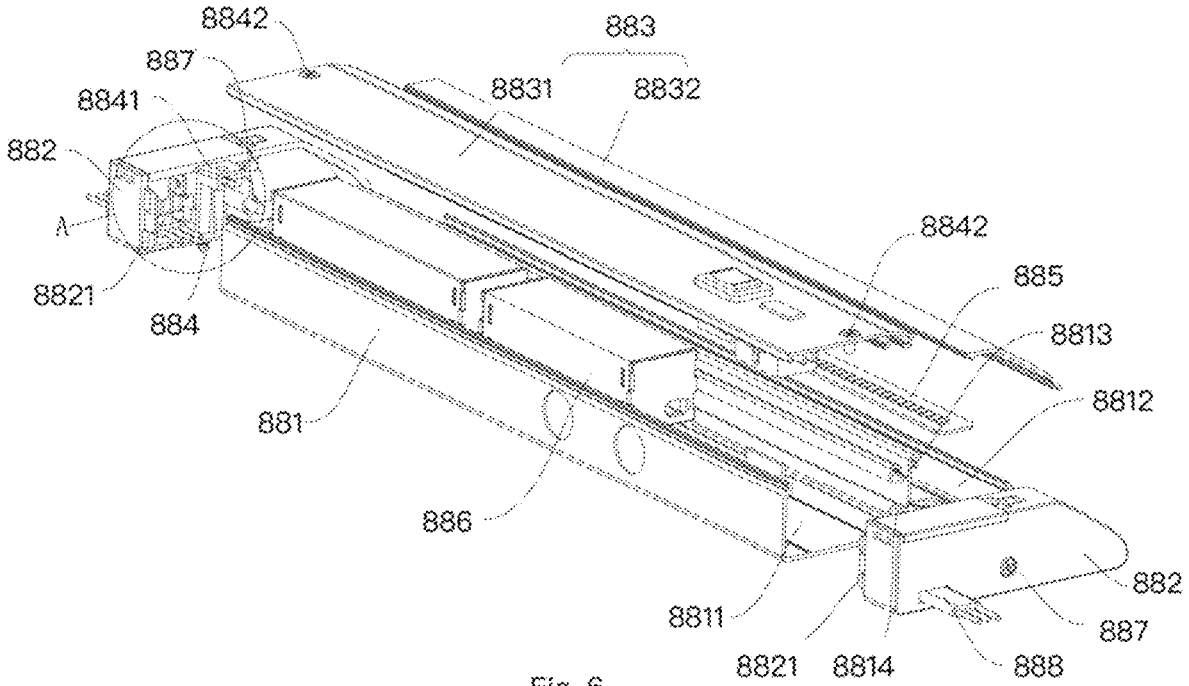
FIG. 6 illustrates an exploded view of an embodiment.

FIG. 6 shows an exploded view of a complete example.

In FIG. 6, there are fastener units 8842, 887 for fixing components together. A concealing cover 883 has a heat dissipation plate 8831 and a light passing cover 8832. There is an installation bracket 8841, a pressing terminal cover 882, an installation connector plate 8821 and a fixing structure 884 at two ends of the main body. There is first container space 8811 and a second container space 8812 for disposing components.

There is a driver 886 disposed to the base housing 881.

Figure 7:
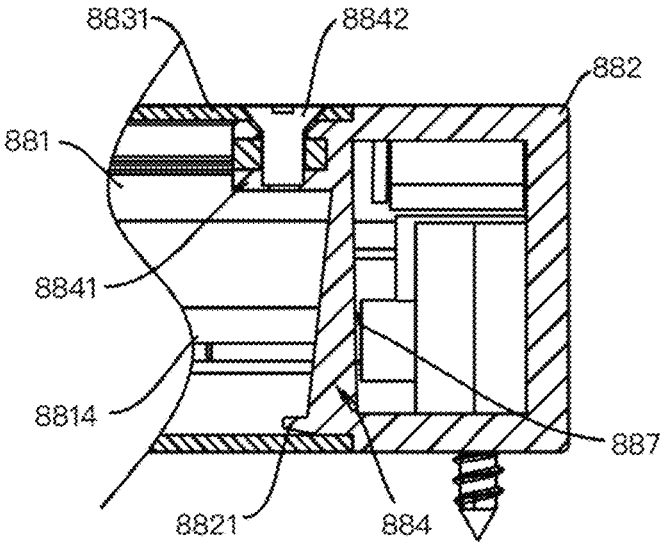
FIG. 7 illustrates a cross-sectional view of components in an example.

FIG. 7 shows a cross-sectional view of the components mentioned in FIG. 6. The fixing groove 8814 and other components together for a structural connection example.

Figure 8:
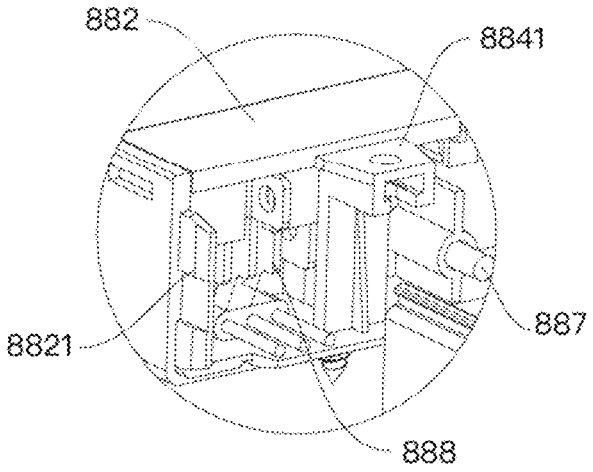
FIG. 8 illustrates a zoom-up view of a wire connector example.

FIG. 8 shows a perspective view of the components in FIG. 6.

Figure 9:
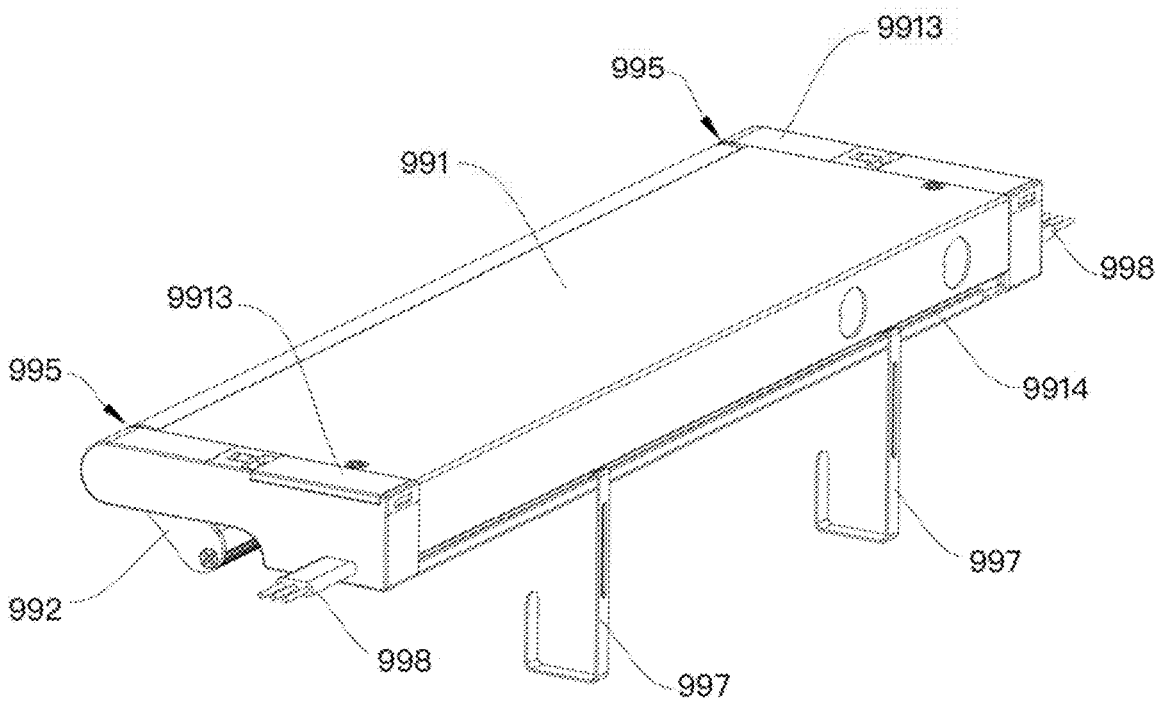
FIG. 9 illustrates an example of a lighting apparatus embodiment.

FIG. 9 shows another example.

In FIG. 9, there is a wire stop 9913 on two ends of the base housing 991. Two wires 998 are connected at two sides of the base housing 991. The positioning structures 995 are used as the base connector connecting to an elongated light source module 992. Two holder hooks 997 are installed to a groove of the base housing 991.

Figure 10:
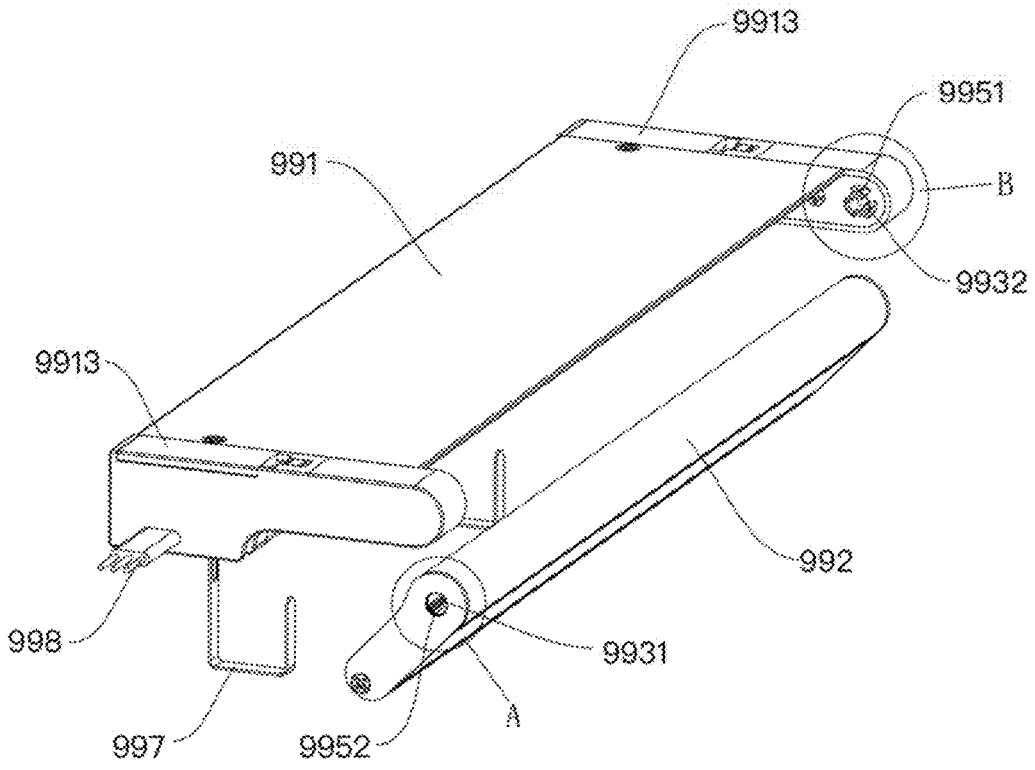
FIG. 10 illustrates the example of FIG. 9, in which the elongated light source module is detached.

In FIG. 10, another view of the example in FIG. 9 is provided.

There is a positioning rim 9951 and a fixing rotation shaft 9932 for installing a light connector 9931 of the elongated light source module 992.

Figure 11:
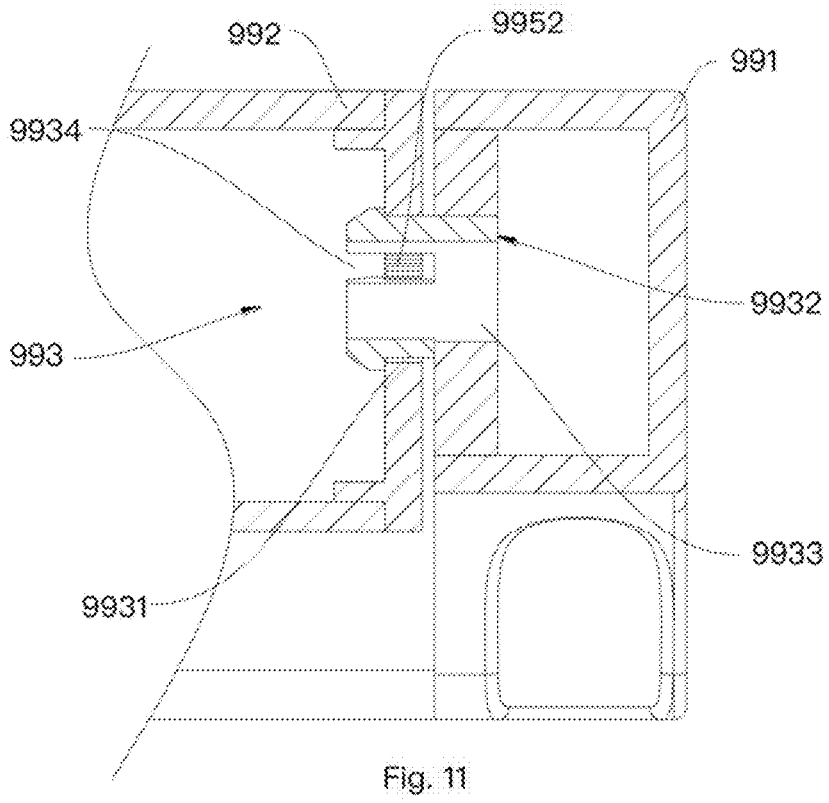
FIG. 11 illustrates a zoom-up view of components in an example.

FIG. 11 shows a cross-sectional view of the example in FIG. 9.

In FIG. 11, there is an escape hole 993, an installation hole 9931, an escape hole 9933, the fixing rotation shaft 9932, and a container groove 9952 as a rotation structure for connecting the elongated light source module and the base housing.

In FIG. 12, the inner circular gear structure 9952 is used for rotating the elongated light source module with respect to the base housing segment by segment.

Figure 13:
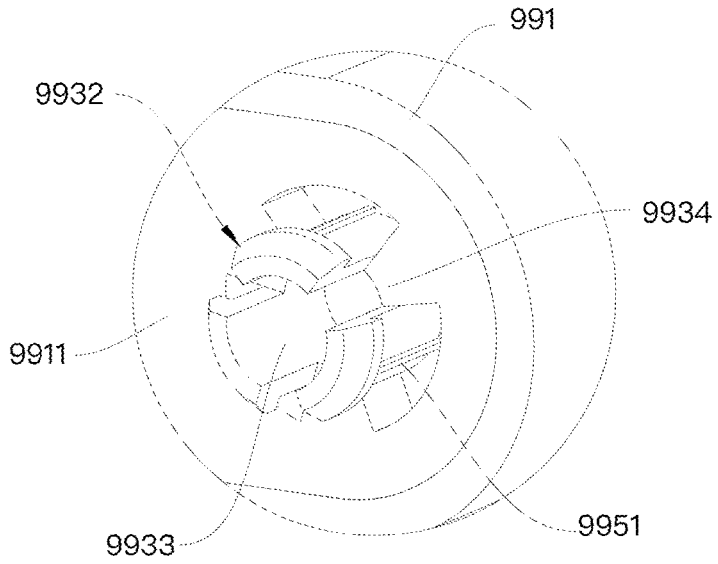
FIG. 13 illustrates a base connector in an embodiment.

FIG. 13 shows the structure of components of a base connector.

Figure 14:
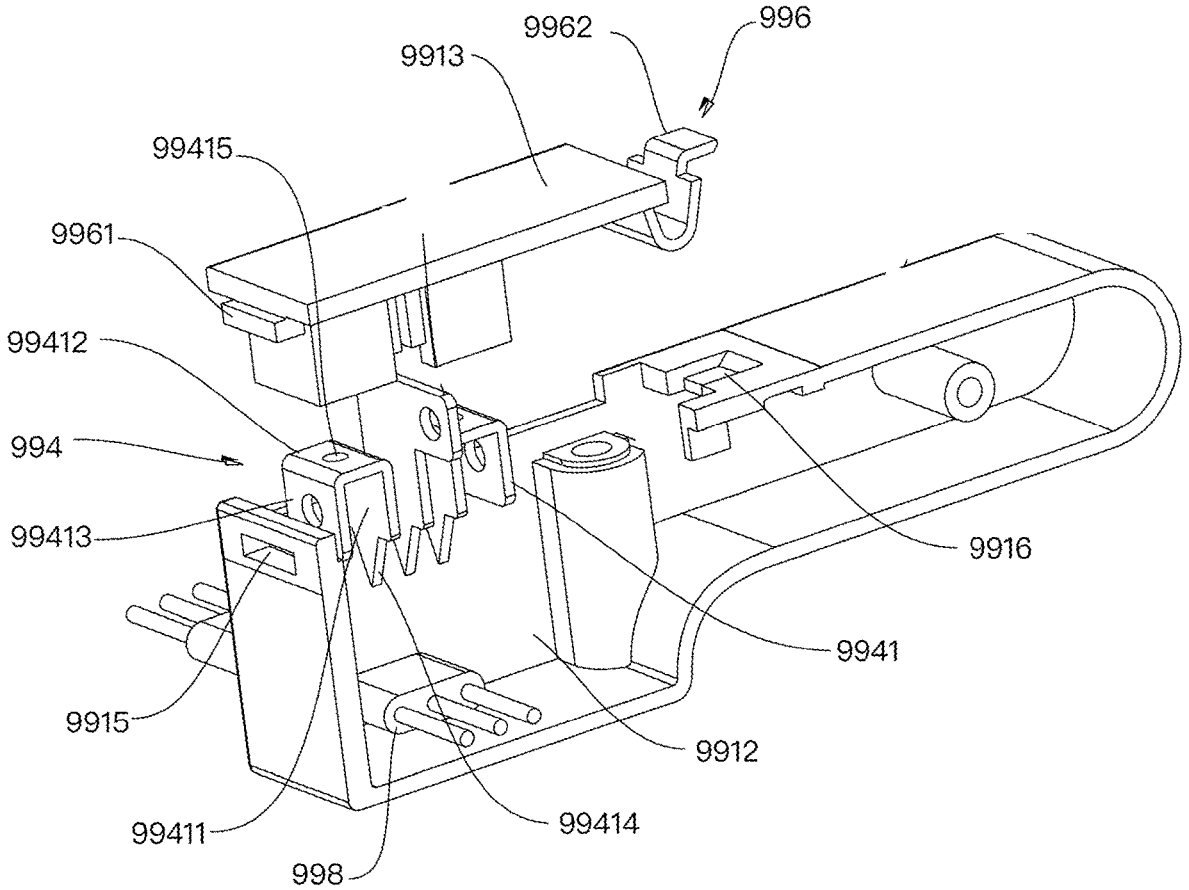
FIG. 14 illustrates a wire stop structure example.

FIG. 14 shows a wire stop 9913 that has a cut unit 99414. There is an elastic buckle 9962 forming a buckle structure 996. There is a fixing structure 99415 for fixing the cut unit 99414 to the wire stop 9913. The wire stop 9913 also has a protruding block 9961 for inserting into the inserting hole 9915. There is a wire clip 99413. The cut unit 99414 and other components form a module 994 to be integrated with the wire stop 9913.

There are also connector units 99412, 99411 for connecting the components. A buckle groove 9916 is used for receiving the elastic buckle 9962. An auxiliary cut unit 9941 may also be used to move in a container space 9912. The wire 998 has an insulation layer that is cut by the cut unit 99414 to exposed its metal part to be electrically connected to a conductive path to components of the lighting apparatus.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A lighting apparatus comprising:

a base housing having a main body and two arms, wherein the two arms are extended from the main body, each of the two arms has a base connector;

an elongated light source module having two light connectors respectively detachably connected to the base connectors of the arms, wherein the elongated light source module emits a light having a main direction, the elongated light source module is rotatable with respect to the base connectors for adjusting the main direction; and at least one holder hook extended from the main body for detachably hooking an object, wherein the main body has a wiring hole disposed with a wire stop, the wire stop has a top pressing unit for being pressed to move the wire stop to fix an inserted wire to the wire stop.

2. The lighting apparatus of claim 1, wherein the holder hook has an electricity socket for supplying power to the objected hooked on the holder hook.

3. The lighting apparatus of claim 2, wherein an auxiliary light device is plugged to the holder hook providing a second light source.

4. The lighting apparatus of claim 1, wherein the elongated light source module has a luminance flat surface.

5. The lighting apparatus of claim 4, wherein the elongated light source module has multiple LED modules divided into multiple areas, each area has a different density of the LED modules for generating a required projection intensity pattern corresponding to the densities of the areas of the LED modules.

6. The lighting apparatus of claim 4, wherein the luminance flat surface is bendable to a curve surface to change a output light pattern.

7. The lighting apparatus of claim 1, wherein the elongated light source module is detachable from the base connector to be replaced with another light device having the same light connectors.

8. The lighting apparatus of claim 7, wherein said another light device is a standard light tube.

9. The lighting apparatus of claim 7, wherein the elongated light source module has a socket for inserting a standard light tube.

10. The lighting apparatus of claim 1, wherein a top surface of the main body is attached to an installation surface.

11. The lighting apparatus of claim 10, wherein a bracket is fixed to the installation surface and the top surface has a fixing connector fixing to the bracket.

12. The lighting apparatus of claim 10, wherein a lateral wall of the main body is fixed to a installation wall.

13. The lighting apparatus of claim 1, wherein the base connector is elastically movable when attaching the corresponding light connector.

14. The lighting apparatus of claim 1, wherein the light connector has a inner circular gear structure corresponding to the base connector for being rotated segment by segment.

15. The lighting apparatus of claim 1, wherein different rotation angles of the elongated light source module with respect to the main body correspond to different light parameters output by the elongated light source module.

16. The lighting apparatus of claim 1, wherein the elongated light source module is turned on and turned off by rotating the elongated light source module to two rotation positions.

17. The lighting apparatus of claim 1, wherein the wire stop has a cut unit for cutting an insulation layer of the inserted wire.

18. The lighting apparatus of claim 1, wherein the main body is connected to an input wire and an output wire, the input wire is used for transmitting an input power and the output wire is used for routing the power supply to a connected device.

19. The lighting apparatus of claim 18, wherein the main body has a power circuit for connecting the input wire and the output wire, the power circuit also has a detector for breaking the power supply to the connected device when abnormal condition is detected at the output wire.

* * * * *